US009892690B2

(12) United States Patent
Zuo

(10) Patent No.: US 9,892,690 B2
(45) Date of Patent: Feb. 13, 2018

(54) CONTROL CIRCUIT FOR BACKLIGHT, A CONTROL METHOD AND A LIQUID CRYSTAL DISPLAY DEVICE

(71) Applicant: Wuhan China Star Optoelectronics Technology Co., Ltd., Wuhan, Hubei (CN)

(72) Inventor: Qingcheng Zuo, Guangdong (CN)

(73) Assignee: Wuhan China Star Optoelectronics Technology Co., Ltd., Wuhan, Hubei (CN)

( * ) Notice: Subject to any disclaimer, the term of this patent is extended or adjusted under 35 U.S.C. 154(b) by 39 days.

(21) Appl. No.: 15/007,603

(22) Filed: Jan. 27, 2016

(65) Prior Publication Data

US 2017/0103710 A1 Apr. 13, 2017

(30) Foreign Application Priority Data

Oct. 12, 2015 (CN) ..... 2015 1 06589955

(51) Int. Cl.
*G09G 3/34* (2006.01)
*G09G 3/36* (2006.01)

(52) U.S. Cl.
CPC ..... *G09G 3/3406* (2013.01); *G09G 3/3648* (2013.01); *G09G 2310/0237* (2013.01); *G09G 2320/0214* (2013.01); *G09G 2320/0233* (2013.01); *G09G 2320/0261* (2013.01); *G09G 2320/064* (2013.01); *G09G 2320/0646* (2013.01)

(58) Field of Classification Search
CPC ..... G09G 2320/064; G09G 3/3406; G09G 2320/0626
See application file for complete search history.

(56) References Cited

U.S. PATENT DOCUMENTS

2005/0007389 A1* 1/2005 Kumamoto ..... G09G 3/3406 345/690
2011/0074301 A1* 3/2011 Goder ..... H05B 33/0818 315/210

(Continued)

FOREIGN PATENT DOCUMENTS

CN CN101777322 A 7/2010
CN CN101995005 A 3/2011

(Continued)

*Primary Examiner* — Gerald Johnson
(74) *Attorney, Agent, or Firm* — Andrew C. Cheng

(57) ABSTRACT

The disclosure shows a control circuit for backlight, a control method and a liquid crystal display device. The control circuit includes a display driving chip used to generate a video frame data enable signal and a first PWM signal; a pulse width modulation control circuit for receiving the video frame data enable signal and the first PWM signal, and modulating a duty ratio of the first PWM signal under the video frame data enable signal control to get a second PWM signal; a backlight driving chip for receiving the second PWM signal, and controlling brightness of the backlight based on the second PWM signal to increase brightness of the backlight during a frame data disable period of the video frame data enable signal. Decreasing brightness in liquid crystal display device caused by leakage characteristic of thin film transistor is solved through the disclosure to achieve consistent brightness.

10 Claims, 4 Drawing Sheets

(56) References Cited

U.S. PATENT DOCUMENTS

| | | | |
|---|---|---|---|
| 2011/0279486 | A1 | 11/2011 | Kang et al. |
| 2013/0038233 | A1 | 2/2013 | Chu et al. |

FOREIGN PATENT DOCUMENTS

| | | | |
|---|---|---|---|
| CN | 102306484 | A | 1/2012 |
| CN | 104007949 | A | 8/2014 |
| KR | 20110133869 | A | 12/2011 |

* cited by examiner

CONTROL CIRCUIT FOR BACKLIGHT, A CONTROL METHOD AND A LIQUID CRYSTAL DISPLAY DEVICE

TECHNICAL FIELD

The disclosure to relates a liquid crystal display field, particularly a control circuit for backlight, a control method and a liquid crystal display device.

BACKGROUND

Content Adaptive Backlight Control (CABC) is a method for analyzing contents of displaying and adjusting backlight of display panel based on contents of gray level and Gamma correction technology.

In present panel display control system, all of the modulation functions of CABC transmit Pulse Width Modulation (PWM) waves from display driving chip to PWM pin of backlight driving chip in order to implement brightness modulation of backlight, and then modulate brightness of a liquid crystal display device.

When video frame data enable signal of liquid crystal display panel during a frame data disable period, brightness of the liquid crystal display device should be constant because PWM wave doesn't change. However, video frame data on liquid crystal pixels are not updated state, meaning that liquid crystal pixels is in charge sustained state, but leakage characteristic of thin film transistor itself causes the decline of pixel voltage of liquid crystal pixels to reduce brightness of the liquid crystal display device.

SUMMARY

The disclosure mainly solve a technical problem that a control circuit for backlight, a control method and a liquid crystal display device, and increase brightness of the liquid crystal display device when a video frame data enable signal is during a frame data disable compensate for decreasing of brightness of the liquid crystal display device caused by leakage characteristic of thin film transistor itself.

To solve the aforementioned technical problem, the disclosure uses a technical solution is providing a control circuit for backlight, and the control circuit includes: a display driving chip used to generate a video frame data enable signal and a first PWM signal; a pulse width modulation control circuit for receiving the video frame data enable signal and the first PWM signal, and modulating a duty ratio of the first PWM signal under the video frame data enable signal control to get a second PWM signal; a backlight driving chip for receiving the second PWM signal, and controlling brightness of the backlight based on the second PWM signal to increase brightness of the backlight during a frame data disable period of the video frame data enable signal.

Wherein, a duty ratio of the second PWM signal is larger than the duty ratio of the first PWM signal during the frame data disable period of the video frame data enable signal.

Wherein, a duty cycle of the second PWM signal is the same as a duty cycle of the first PWM signal during the frame data disable period of the video frame data enable signal; wherein, the duration of the frame data disable period of the video frame data enable signal is integer times of duty cycle of the first PWM signal or duty cycle of the second PWM signal.

Wherein, the duty ratio of the second PWM signal is the same as the duty ratio of the first PWM signal during a frame data enable period of the video frame data enable signal.

Wherein, the control circuit further comprises a signal generator, and the signal generator is used to generate a video frame signal; wherein, the display driving chip connects to the signal generator for generating the video frame data enable signal and the first PWM signal under the video frame signal control.

To solve the aforementioned technical problem, the disclosure uses another technical solution is: providing a liquid crystal display device including aforementioned backlight of the control circuit.

To solve the aforementioned technical problem, the disclosure also uses another technical solution is providing a control method for backlight, and the control method includes: receiving a video frame data enable signal and a first PWM signal, and modulating a duty ratio of the first PWM signal under the video frame data enable signal control to obtain a second PWM signal; controlling brightness of the backlight based on the second PWM signal to increase brightness of the backlight during a frame data disable period of the video frame data enable signal.

Wherein, steps of modulating the duty ratio of the first PWM signal to obtain the second PWM signal under the video frame data enable signal control is specifically: starting to modulate the duty ratio of the first PWM signal to obtain the second PWM signal in order that a duty ratio of the second PWM signal is larger than the duty ratio of the first PWM signal when the video data enable signal get into the frame data disable period; stopping modulating the operation of the duty ratio of the first PWM signal to make the first PWM signal and the second PWM signal joint when the video data enable signal get into a frame data enable period from the frame data disable period.

Wherein, steps of controlling brightness of the backlight based on the second PWM signal to increase brightness of the backlight located in a frame data disable period of the video frame data enable signal is specifically: providing an output current for the backlight based on the duty ratio of the second PWM signal to increase the output current for the backlight during the frame data disable period of the video frame data enable signal.

Wherein, before obtaining the video frame data enable signal and the first PWM signal, the method further comprises steps: receiving the video frame signal; generating the video frame data enable signal and the first PWM signal under the video frame signal control.

The benefit of the disclosure is the control circuit for backlight, the control method and the liquid crystal display device of the disclosure modulate the duty ratio of the first PWM signal to obtain the second PWM signal under the video frame data enable signal control, thereby control brightness of the backlight based on the second PWM signal to increase brightness of the backlight during a frame data disable period of the video frame data enable signal, then compensate for decreasing of brightness of the liquid crystal display device within the frame data disable period caused by leakage characteristic of thin film transistor itself and achieve that brightness of the liquid crystal display device is consistent.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. The present disclosure will hereinafter be described in detail with reference to the accompanying drawings and embodiments.

Figure 1:
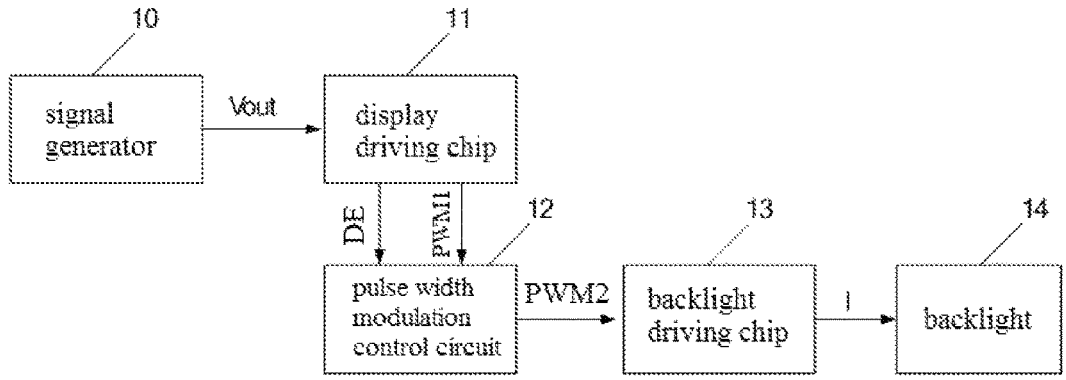
FIG. 1 is a structural schematic diagram of a control circuit for backlight according to an embodiment of the present disclosure.
Figure 2:
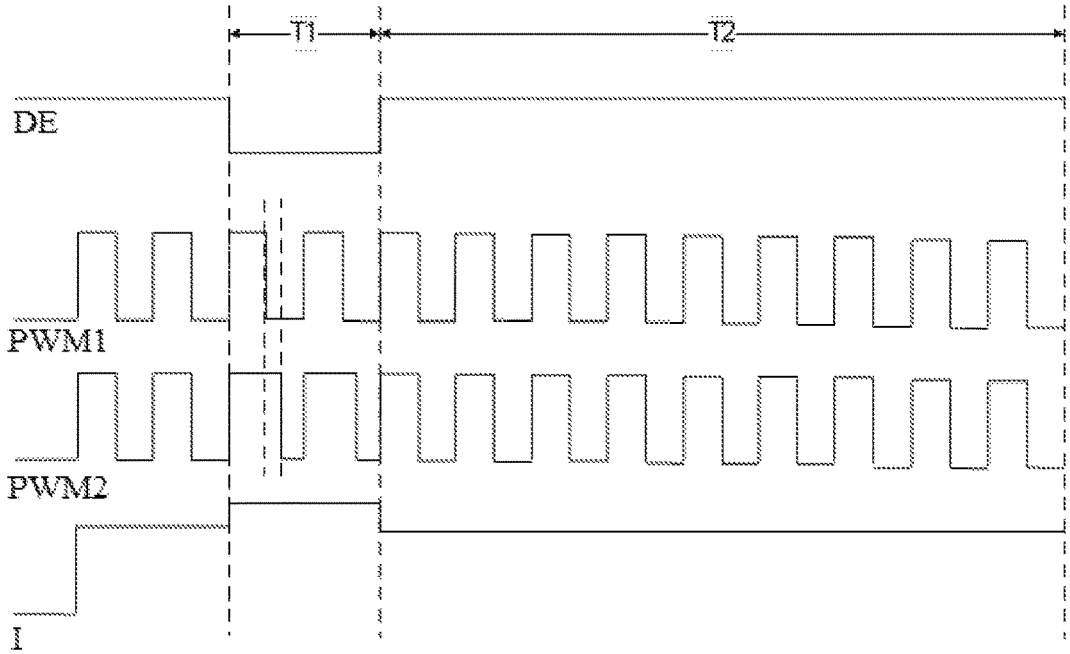
FIG. 2 is a control sequential diagram of the control circuit for backlight according to FIG. 1.

Referring to FIG. 1 and FIG. 2, FIG. 1 is a structural schematic diagram of a control circuit for backlight according to an embodiment of the present disclosure, and FIG. 2 is a control sequential diagram of the control circuit for backlight according to FIG. 1. As shown in FIG. 1, the control circuit 100 comprises a signal generator 10, a display driving chip 11, a pulse width modulation control circuit 12, a backlight driving chip 13 and a backlight 14.

The signal generator 10 is used to generate a video frame signal Vout.

The display driving chip 11 connects to the signal generator 10 for generating the video frame data enable signal DE and the first PWM signal PWM1 under the video frame signal Vout control.

The pulse width modulation control circuit 12 connects to the display driving chip 11 for receiving the video frame data enable signal DE and the first PWM signal PWM1, and modulating a duty ratio of the first PWM signal under the video frame data enable signal control DE to get a second PWM signal PWM2.

Specifically, the video frame data enable signal DE includes a frame data disable period T1 and a frame data enable period T2; wherein, when the video frame data enable signal DE is at low potential, the video frame data enable signal DE is within the frame data disable period T1 and when the video frame data enable signal DE is at high potential, the video frame data enable signal DE is within the frame data disable period T2. Certainly, one skilled in the art could understand, and in other embodiments, it also could be that when the video frame data enable signal DE is at high potential, the video frame data enable signal DE is within the frame data disable period T1 and when the video frame data enable signal DE is at low potential, the video frame data enable signal DE is within the frame data disable period T2 and the disclosure is not limited thereof.

When the video frame data enable signal DE get into the frame data disable period T1, that is, the video frame data enable signal DE turns into low potential from high potential, the pulse width modulation control circuit 12 starts to modulate the duty ratio of the first PWM signal PWM1 to obtain the second PWM signal PWM2 in order that a duty ratio of the second PWM signal PWM2 is larger than the duty ratio of the first PWM signal PWM1; Preferably, a duty cycle of the second PWM signal PWM 2 is the same as a duty cycle of the first PWM signal PWM1 during the frame data disable period T1 of the video frame data enable signal DE; wherein, the duration of the frame data disable period T1 of the video frame data enable signal DE is twice of duty cycle of the first PWM signal PWM1 or duty cycle of the second PWM signal PWM2, for example twice illustrated in FIG. 2.

When the video frame data enable signal DE get into the frame data enable period T2 from the frame data disable period T1, that is, the video frame data enable signal DE turns into high potential from low potential, the pulse width modulation control circuit 12 stops modulating the operation of the duty ratio of the first PWM signal PWM1 to make the first PWM signal PWM1 and the second PWM signal PWM2 joint. That is, when the video frame data enable signal DE is within the frame data disable period T2, the duty ratio of the second PWM signal PWM2 is the same as the duty ratio of the first PWM signal PWM1, and the duty cycle of the second PWM signal PWM 2 is the same as the duty cycle of the first PWM signal PWM1.

The backlight driving chip 13 connects to the pulse width modulation control circuit 12 for receiving the second PWM signal PWM2, and controlling brightness of the backlight 14 based on the second PWM signal PWM2 to increase brightness of the backlight 14 during a frame data disable period T1 of the video frame data enable signal DE.

Specifically, the backlight driving chip 13 provides an output current I for the backlight 14 based on the duty ratio of the second PWM signal PWM2. Wherein, the output current I for the backlight 14 and the duty ratio of the second PWM signal PWM2 are in direct proportion, that is, the larger the duty ratio of the second PWM signal PWM2 is, the more the output current I for the backlight 14 is. the duty ratio of the second PWM signal PWM2 during the frame data disable period T1 of the video frame data enable signal DE is larger than during the frame data enable period T2; therefore, the backlight driving chip 13 provides the output current I for the backlight 14 within the frame data disable period T1 larger than provides the output current I within the frame data enable period T2 so that brightness of the backlight 14 during a frame data disable period T1 is increased, and then brightness of the liquid crystal display device is also increased.

Wherein, during a frame data disable period T1 of the video frame data enable signal DE, the output current provided the backlight 14 is larger than 20 mA, and during a frame data enable period T2 of the video frame data enable signal DE, the output current provided the backlight 14 is the same as 20 mA.

Figure 3:
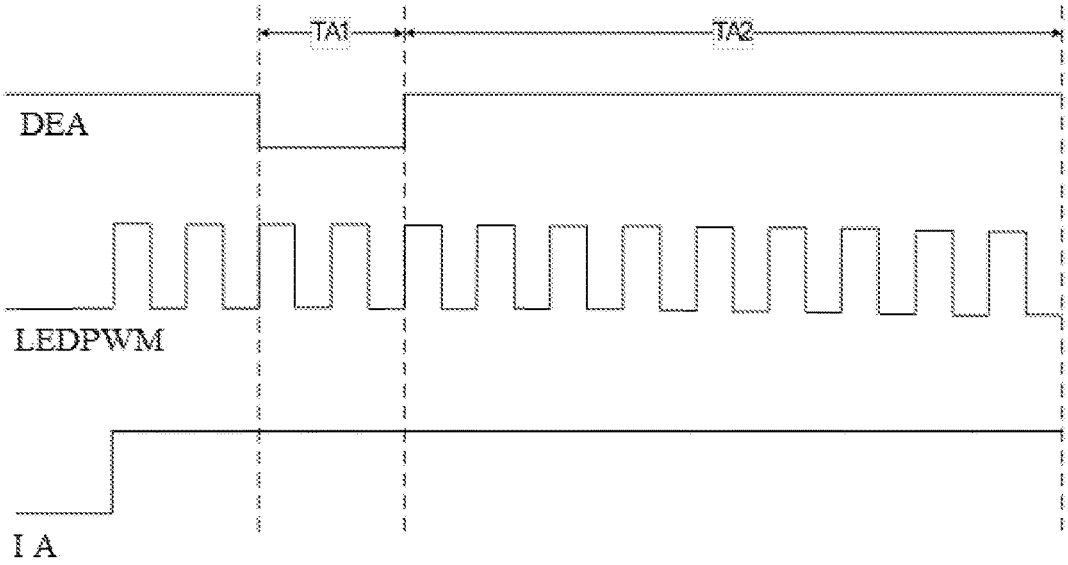
FIG. 3 is a control sequential diagram of the control circuit for backlight according to the present technology.

Please also refer to FIG. 3, and FIG. 3 is a control sequential diagram of the control circuit for backlight according to the present technology. Comparing FIG. 1 and FIG. 2 can be understood:

the duty ratio of the second PWM signal PWM2 of the control circuit for backlight in the disclosure during the frame data disable period T1 of the video frame data enable signal DE is larger than during the frame data enable period T2 so that the backlight driving chip 13 provides the output current I for the backlight 14 within the frame data disable period T1 larger than provides the output current I for the backlight 14 within the frame data enable period T2, thereby brightness of the backlight 14 during a frame data disable period T1 is increased, and then brightness of the liquid crystal display device is also increased to counteract leakage characteristic of thin film transistor itself that causes the decline of pixel voltage within the frame data disable period T1 to reduce brightness of the liquid crystal display device.

Still, no matter during a frame data disable period T1A of the video frame data enable signal DEA or during a frame data enable period T2A, a duty ratio of a LEDPWM signal LEDPWM of the present control circuit for backlight is constant so that no matter during the frame data disable period T1A or during the frame data enable period T2A, an output current IA should be constant, thereby leakage characteristic of thin film transistor itself that causes the decline of pixel voltage within the frame data disable period T1A to reduce brightness of the liquid crystal display device.

Figure 4:
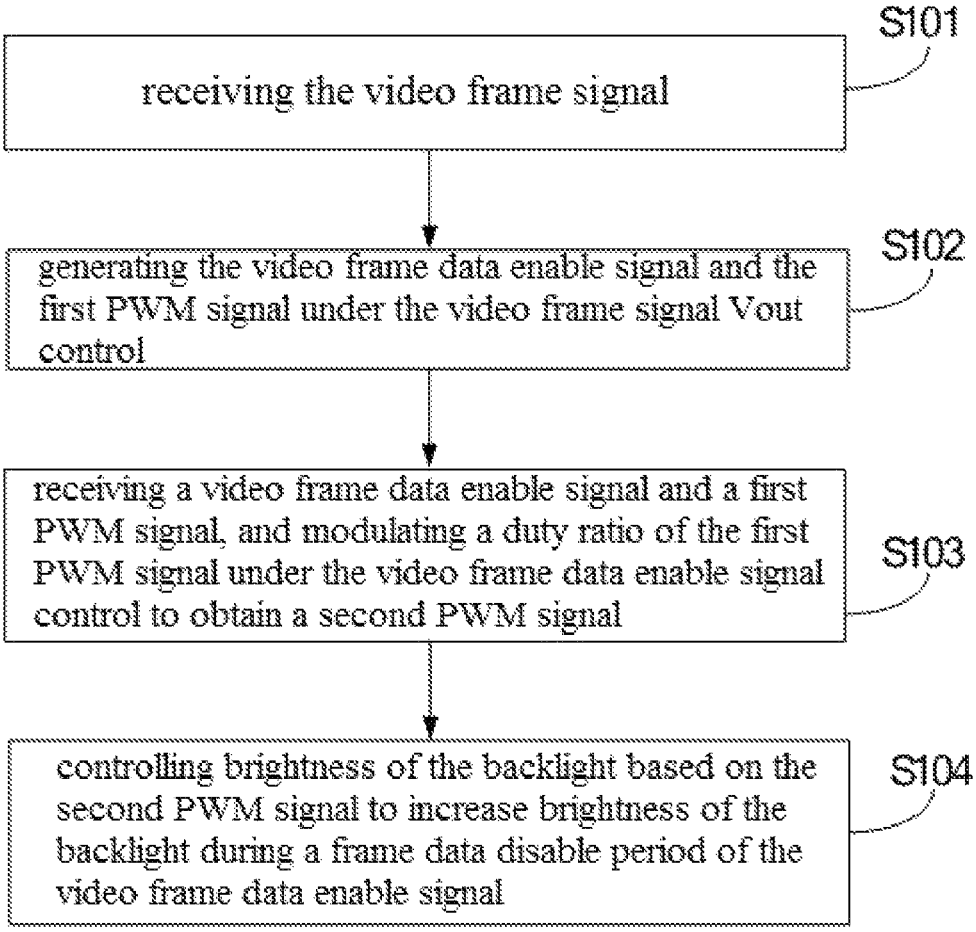
FIG. 4 is a control sequential diagram of a controlling method of the control circuit for backlight according to FIG. 1.

FIG. 4 is a control sequential diagram of a controlling method of the control circuit for backlight according to FIG. 1. As shown in FIG. 4, the method comprises steps:

Step S101: receiving the video frame signal.

In step S101, the display driving chip 11 receives the video frame signal Vout generated by the signal generator 10.

Step S102: generating the video frame data enable signal and the first PWM signal under the video frame signal Vout control.

In step S102, the display driving chip 11 generates the video frame data enable signal DE and the first PWM signal PWM1 under the video frame signal Vout control. Wherein, the video frame data enable signal DE includes a frame data disable period T1 and a frame data enable period T2; wherein, when the video frame data enable signal DE is at low potential, the video frame data enable signal DE is within the frame data disable period T1 and when the video frame data enable signal DE is at high potential, the video frame data enable signal DE is within the frame data disable period T2. Wherein, the first PWM signal PWM1 is a PWM signal with an unchanged duty ratio and an unchanged cycle.

Step S103: receiving a video frame data enable signal and a first PWM signal, and modulating a duty ratio of the first PWM signal under the video frame data enable signal control to obtain a second PWM signal;

In step S103, the pulse width modulation control circuit 12 receives the video frame data enable signal DE and the first PWM signal PWM1 generated by the display driving chip 11, and modulates a duty ratio of the first PWM signal under the video frame data enable signal control DE to get a second PWM signal PWM2;

Specifically, when the video frame data enable signal DE get into the frame data disable period T1, that is, the video frame data enable signal DE turns into low potential from high potential, the pulse width modulation control circuit 12 starts to modulate the duty ratio of the first PWM signal PWM1 to obtain the second PWM signal PWM2 in order that a duty ratio of the second PWM signal PWM2 is larger than the duty ratio of the first PWM signal PWM1. Preferably, a duty cycle of the second PWM signal PWM 2 is the same as a duty cycle of the first PWM signal PWM1 during the frame data disable period T1 of the video frame data enable signal DE; wherein, the duration of the frame data disable period T1 of the video frame data enable signal DE is twice of duty cycle of the first PWM signal PWM1 or duty cycle of the second PWM signal PWM2, for example twice illustrated in FIG. 2.

When the video frame data enable signal DE get into the frame data enable period T2 from the frame data disable period T1, that is, the video frame data enable signal DE turns into high potential from low potential, the pulse width modulation control circuit 12 stops modulating the operation of the duty ratio of the first PWM signal PWM1 to make the first PWM signal PWM1 and the second PWM signal PWM2 joint. That is, when the video frame data enable signal DE is within the frame data disable period T2, the duty ratio of the second PWM signal PWM2 is the same as the duty ratio of the first PWM signal PWM1, and the duty cycle of the second PWM signal PWM 2 is the same as the duty cycle of the first PWM signal PWM1.

Step S104: controlling brightness of the backlight based on the second PWM signal to increase brightness of the backlight during a frame data disable period of the video frame data enable signal.

In step S104, the backlight driving chip 13 receives the second PWM signal PWM2 generated by the display driving chip 11, and controls brightness of the backlight 14 based on the second PWM signal PWM2 to increase brightness of the backlight 14 during a frame data disable period T1 of the video frame data enable signal DE.

Specifically, the backlight driving chip 13 provides an output current I for the backlight 14 based on the duty ratio of the second PWM signal PWM2. Wherein, the output current I for the backlight 14 and the duty ratio of the second PWM signal PWM2 are in direct proportion, that is, the larger the duty ratio of the second PWM signal PWM2 is, the more the output current I for the backlight 14 is. The duty ratio of the second PWM signal PWM2 during the frame data disable period T1 of the video frame data enable signal DE is larger than during the frame data enable period T2; therefore, the backlight driving chip 13 provides the output current I for the backlight 14 within the frame data disable period T1 larger than provides the output current I within the frame data enable period T2 so that brightness of the backlight 14 during a frame data disable period T1 is increased, and then brightness of the liquid crystal display device within the frame data disable period T1 is also increased to counteract leakage characteristic of thin film transistor itself that causes the decline of pixel voltage within the frame data disable period T1 to reduce brightness of the liquid crystal display device.

Figure 5:
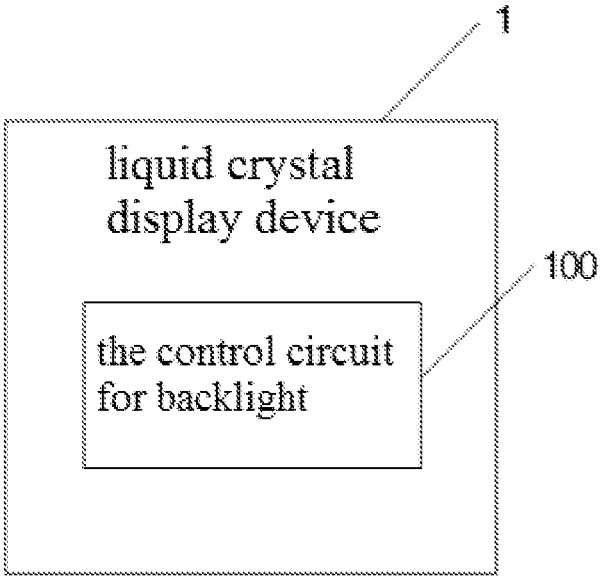
FIG. 5 is a structural schematic diagram of a liquid crystal display device according to an embodiment of the present disclosure.

FIG. 5 is a structural schematic diagram of a liquid crystal display device according to an embodiment of the present disclosure. As shown in FIG. 5, the liquid crystal display device 1 includes the control circuit 100 for backlight.

The benefit of the disclosure is the control circuit for backlight, the control method and the liquid crystal display device of the disclosure modulate the duty ratio of the first PWM signal to obtain the second PWM signal under the video frame data enable signal control, thereby control brightness of the backlight based on the second PWM signal to increase brightness of the backlight during a frame data disable period of the video frame data enable signal, then compensate for decreasing of brightness of the liquid crystal display device caused by leakage characteristic of thin film transistor itself and achieve that brightness of the liquid crystal display device is consistent within the frame data disable period.

Above are only embodiments of the present disclosure is not patented and therefore limit the scope of the present disclosure, any use of the contents of the present specification and drawings made equivalent or equivalent structural transformation process, either directly or indirectly related technologies used in other areas are included in the patent empathy scope of the disclosure.

The invention claimed is:

1. A control circuit for backlight, comprising:

a display driving chip used to generate a video frame data enable signal and a first PWM signal;

a pulse width modulation control circuit for receiving the video frame data enable signal and the first PWM signal, and modulating a duty ratio of the first PWM signal under the video frame data enable signal control to get a second PWM signal;

a backlight driving chip for receiving the second PWM signal, and controlling brightness of the backlight based on the second PWM signal to increase brightness of the backlight during a frame data disable period of the video frame data enable signal.

2. The control circuit according to claim 1, wherein a duty ratio of the second PWM signal is larger than the duty ratio of the first PWM signal during the frame data disable period of the video frame data enable signal.

3. The control circuit according to claim 2, wherein a duty cycle of the second PWM signal is the same as a duty cycle of the first PWM signal during the frame data disable period of the video frame data enable signal; wherein, the duration of the frame data disable period of the video frame data enable signal is integer times of duty cycle of the first PWM signal or duty cycle of the second PWM signal.

4. The control circuit according to claim 2, wherein the duty ratio of the second PWM signal is the same as the duty ratio of the first PWM signal during a frame data enable period of the video frame data enable signal.

5. The control circuit according to claim 1, wherein the control circuit further comprises a signal generator, and the signal generator is used to generate a video frame signal;

Wherein, the display driving chip connects to the signal generator for generating the video frame data enable signal and the first PWM signal under the video frame signal control.

6. A liquid crystal display device, wherein the liquid crystal display device comprises the backlight of the control circuit according to claim 1.

7. A controlling method for backlight, wherein the controlling method comprises:

generating a video frame data enable signal and a first PWM signal under a video frame signal control;

receiving video frame data enable signal and first PWM signal, and modulating a duty ratio of the first PWM signal under the video frame data enable signal control to obtain a second PWM signal;

controlling brightness of the backlight based on the second PWM signal to increase brightness of the backlight during a frame data disable period of the video frame data enable signal.

8. A controlling method according to claim 7, wherein steps of modulating the duty ratio of the first PWM signal to obtain the second PWM signal under the video frame data enable signal control is specifically:

starting to modulate the duty ratio of the first PWM signal to obtain the second PWM signal in order that a duty ratio of the second PWM signal is larger than the duty ratio of the first PWM signal when the video data enable signal get into the frame data disable period;

stopping modulating the operation of the duty ratio of the first PWM signal to make the first PWM signal and the second PWM signal joint when the video data enable signal get into a frame data enable period from the frame data disable period.

9. A controlling method according to claim 7, wherein steps of controlling brightness of the backlight based on the second PWM signal to increase brightness of the backlight located in a frame data disable period of the video frame data enable signal is specifically:

providing an output current for the backlight based on the duty ratio of the second PWM signal to increase the output current for the backlight during the frame data disable period of the video frame data enable signal.

10. A controlling method according to claim 7, wherein before obtaining the video frame data enable signal and the first PWM signal, the method further comprises steps:

receiving the video frame signal.

* * * * *